US007815461B2

(12) United States Patent
Oka

(10) Patent No.: US 7,815,461 B2
(45) Date of Patent: Oct. 19, 2010

(54) CONNECTOR FOR VEHICLES HAVING A VIBRATION-PROOF EFFECT AGAINST VIBRATION OF A SHIELDED ELECTRIC WIRE

(75) Inventor: Taichi Oka, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 12/421,741

(22) Filed: Apr. 10, 2009

(65) Prior Publication Data

US 2009/0258531 A1 Oct. 15, 2009

(30) Foreign Application Priority Data

Apr. 10, 2008 (JP) ..... 2008-102366

(51) Int. Cl.
*H01R 13/648* (2006.01)
*H01R 4/38* (2006.01)

(52) U.S. Cl. ..... 439/382

(58) Field of Classification Search ..... 439/275, 439/279, 274, 382, 587, 588, 589, 579, 580
See application file for complete search history.

(56) References Cited

U.S. PATENT DOCUMENTS 2,986,720 A * 5/1961 Chess ..... 439/583

FOREIGN PATENT DOCUMENTS

JP 2005-019287 1/2005

* cited by examiner

*Primary Examiner*—Javaid Nasri
(74) *Attorney, Agent, or Firm*—Martin Fleit; Fleit Gibbons Gutman Bongini & Bianco PL

(57) ABSTRACT

A connector of the present invention includes: a first terminal electrically connected to a conductor wire of a shielded electric wire; a second terminal electrically connected to the first terminal; a housing provided so as to surround a connection part of the first terminal and the second terminal and a peripheral part thereof, composed of a first housing that holds the first terminal and a second housing that holds the second terminal; and a shielded electric wire support member provided in the first housing, for grasping an insulator coating of the shielded electric wire inserted into the first housing, and supporting the shielded electric wire by the first housing in contact with an inner wall of the first housing.

12 Claims, 4 Drawing Sheets

CONNECTOR FOR VEHICLES HAVING A VIBRATION-PROOF EFFECT AGAINST VIBRATION OF A SHIELDED ELECTRIC WIRE

BACKGROUND

1. Technical Field

The present invention relates to a connector for connecting a terminal for electrical circuit connection, to a shielded electric wire, and for example relates to a connector particularly suitable for the purpose of use subjected to constant vibration or a harsh environment such as a violent change of a temperature, like a connector used in automobiles or the other vehicles.

2. Description of Related Art

In order to perform a highly reliable electrical connection by a connector, radiation of a noise (electromagnetic waves) generated from the connector must be prevented. Therefore, a terminal is covered with a metal shield shell or an outer housing (simply called a housing in some cases), and the shield shell or the outer housing is connected to a braided conductor (shield) of a shielded electric wire by a conductive member made of a metal material such as a ferrule, to thereby make a generally used so-called electrostatic shielding structure in which a conductive path including the terminal and the shielded electric wire is completely covered with the shield shell or the outer housing.

When the outer housing is formed of a conductive material such as a metal material, the outer housing itself serves as the shield shell, thus making it possible to omit the shield shell. However, when the outer housing is formed of a resin material, the shield shell made of a metal material is disposed in the outer housing.

Generally, a vehicle such an automobile is used in various districts and environment. Therefore, the connector for automobiles is subjected to a harsh environment in which a circumference temperature is violently changed from a frigid low temperature to a high temperature beyond a boiling point of water, like −40° C. to 120° C. In addition, generally an influence of vibration from a road surface or an engine is constantly received, during traveling of the automobiles.

In the connector for automobiles which is frequently subjected to a constant vibration under such a harsh environment, it is strongly requested to prevent abrasion of the terminal and an increase of a contact resistance caused by vibration. Therefore, patent document 1 proposes a countermeasure to suppress a looseness of the outer housing and the inner housing, etc, that hold the terminal inside of the outer housing, by providing a looseness restriction member inside of the connector.

(Patent Document 1)

Japanese Patent Laid Open Publication No. 2005-19287

However, even if using the conventionally proposed looseness restriction member for preventing the looseness of the aforementioned outer housing and inner housing, etc, there is still a problem that the abrasion of the terminal and increase of the contact resistance occur caused by vibration. Therefore, it is difficult to ensure reliability and durability of an electrical connection of the connector.

SUMMARY OF THE INVENTION

An object of the present invention is to provide the connector capable of ensuring the reliability and a long time durability of the electrical connection, by surely preventing the occurrence of the abrasion of the terminal and the increase of the contact resistance caused by the vibration of the shielded electric wire.

One aspect of the present invention provides a connector, including:

- a first terminal electrically connected to a conductor wire of a shielded electric wire;
- a second terminal electrically connected to the first terminal;
- a housing provided so as to surround a connection part of the first terminal and the second terminal and a peripheral part thereof, composed of a first housing that holds the first terminal and a second housing that holds the second terminal; and
- a shielded electric wire support member provided in the first housing, for grasping an insulator coating of the shielded electric wire inserted into the first housing, and supporting the shielded electric wire by the first housing in contact with an inner wall of the first housing.

BEST MODE FOR CARRYING OUT THE INVENTION

A connector according to an embodiment of the present invention will be described, with reference to the drawings.

Figure 1:
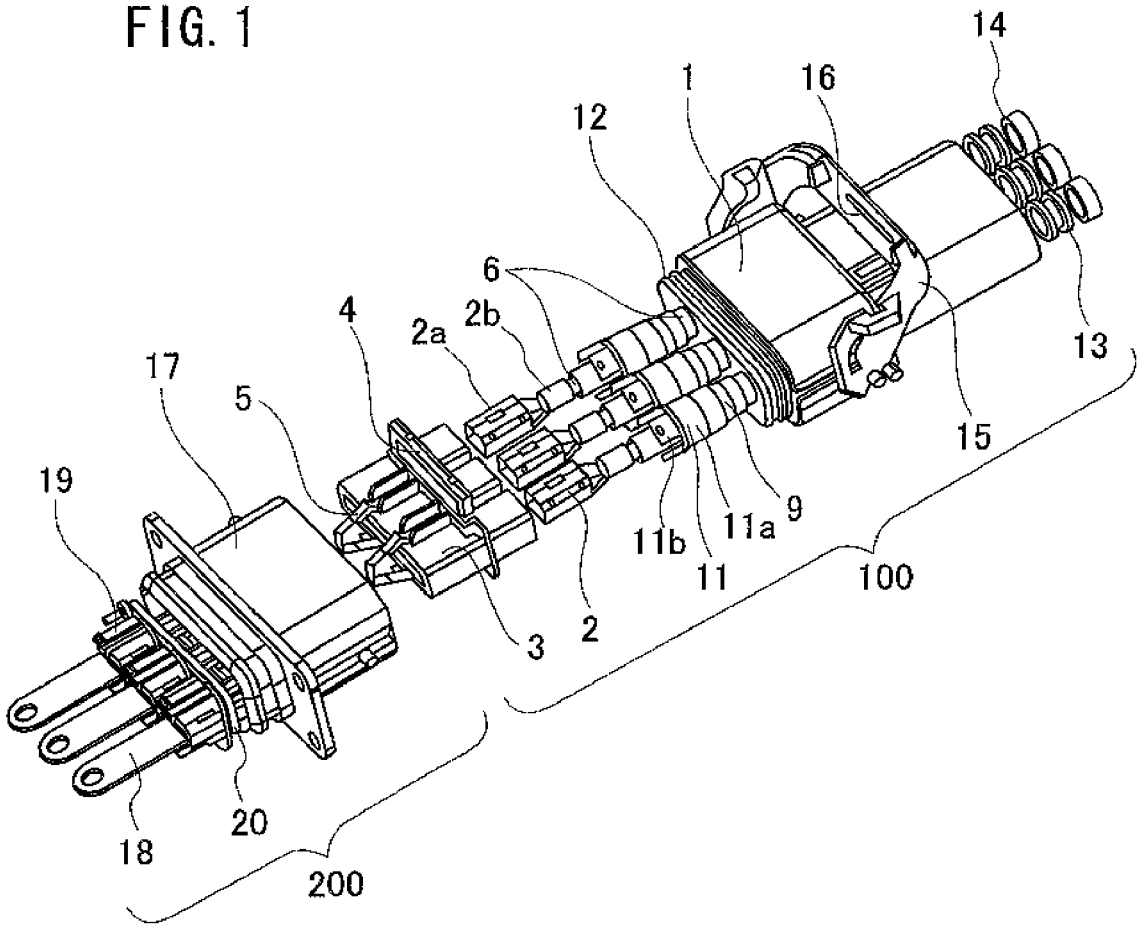
FIG. 1 is an exploded perspective view for describing a state of connecting a connector of a first embodiment to a shielded electric wire.
Figure 2:
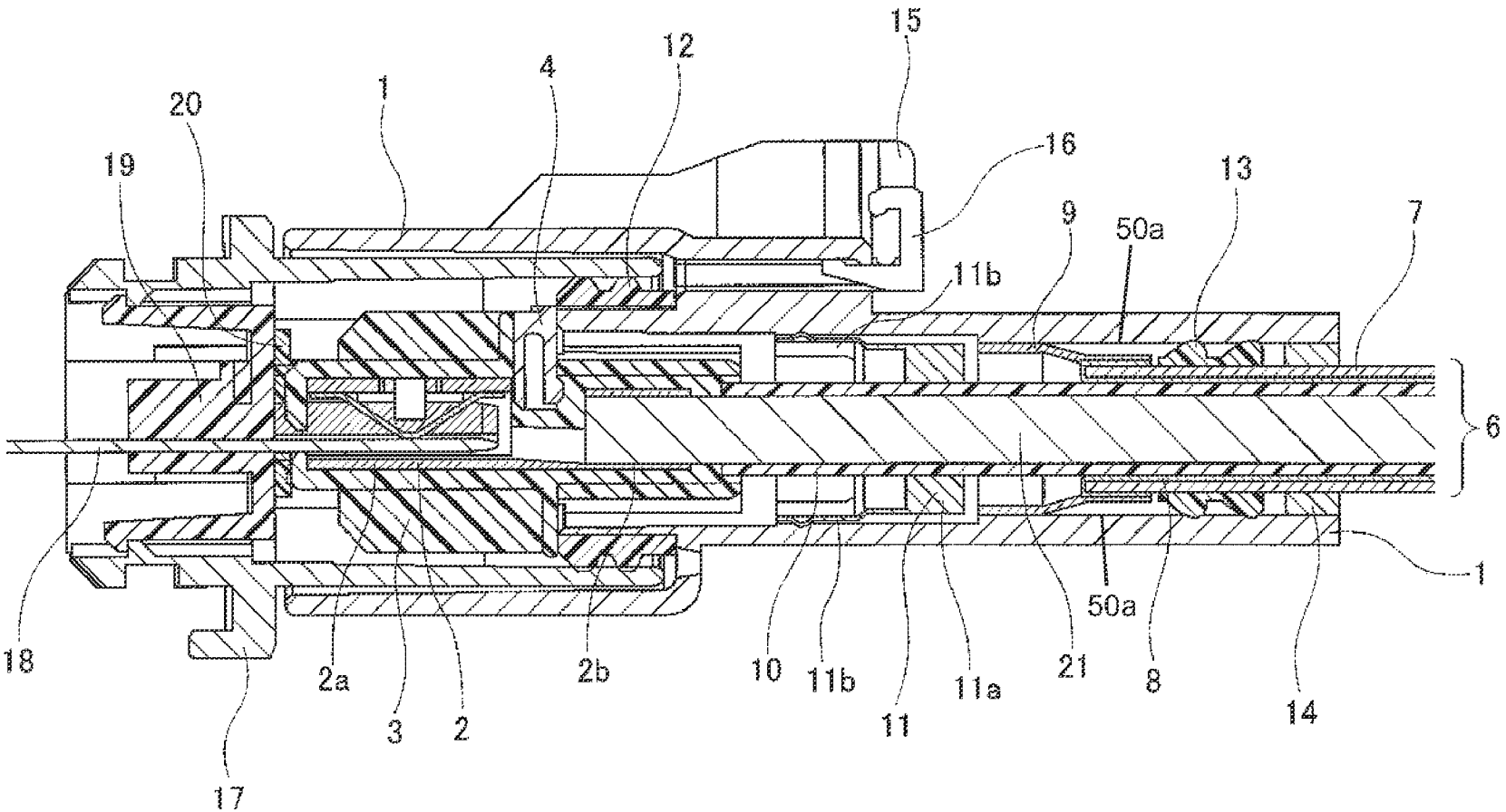
FIG. 2 is a longitudinal sectional view showing a state of connecting the connector shown in FIG. 1 to the shielded electric wire.

FIG. 1 is an exploded perspective view for describing a state in which the connector of an embodiment of the present invention is connected to a shielded electric wire, and FIG. 2 is a longitudinal sectional view of a connection state in which the connector of FIG. 1 is connected to the shielded electric wire.

This connector is suitable for being used under an environment frequently subjected to a generated vibration and a violent change of a temperature, like an engine room of an automobile. For example, the vibration of a vehicle body during traveling of a vehicle, the vibration during drive of a motor or an inverter in a HEV (Hybrid Electric Vehicle) and an EV (Electric Vehicle), or the vibration from an engine, or the like, are transmitted to a shielded electric wire 6 to vibrate the shielded electric wire 6. This connector is designed so that the vibration (including resonance) of the shielded electric wire 6 is tremendously reduced, to inhibit/intercept the vibration of the shielded electric wire 6 from being transmitted to a first terminal 2 or a first outer housing 1, to thereby prevent a abrasion or an increase of a contact resistance from occurring between the first terminal 2 and a second terminal 18, caused by the vibration of the shielded electric wire 6

The shielded electric wire 6 to which the connector of this embodiment is connected, is constituted of a conductor wire 21 made of a metal material in the center; an insulator coating 10 made of an insulating material for coating an outer periphery of the conductor wire 21; a braided conductor 8 as an external conductor (shield) formed in such a manner as coating the outer periphery of the insulator coating 10; and a sheath 7 made of the insulating material for protecting the outer periphery of the braided conductor 8. Although the connector of this embodiment functions to connect three shielded electric wires 6, it can also function to connect one, two, or four or more shield electric wires 6. Also, as a so-called external conductor in the shield wire 6, for example, a conductor wire in a linear state or an intertwisted state can be used, other than the aforementioned braided conductor 8.

Note that the shielded electric wire, to which the connector of the present invention is connected, has the following structure. Namely, an outer periphery of one or a plurality of bundles of coated electric wires, with outer periphery of the conductor wire coated with the insulating material, is electrically shielded by an external conductor. Also, the shielded electric wire, to which the connector of the present invention is connected, includes a cable having a structure similar thereto.

The connector of this embodiment is set so that by connecting a first connector 100, being a so-called female side connector, and a second connector 200, being a male side connector, electrical connection between them can be made.

A main essential part of the first connector 100, being the female side connector, is constituted of a first outer housing 1, being a female connector case; a first terminal 2, being a female terminal; and a first inner housing 3 provided at one end portion in the first outer housing 1, for holding the first terminal 2 while electrically insulating the first terminal 2 from the first outer housing 1. A first housing is constituted of the first outer housing 1 and the first inner housing 3.

Further, the first connector 100 includes an inner plate 4 for preventing detachment of the first terminal 2 (detached in the right side direction in FIG.1 and FIG. 2) from the first inner housing 3; a ground contact 5 provided in the first inner housing 3, in contact with an inner wall 50*a* of the first outer housing 1; a cylindrical ferrule 9 crimped to a part where the braided conductor 8 is exposed from the sheath 7 of the shielded electric wire 6, electrically connected to the braided conductor 8, and contacted with the inner wall 50*a* of the first outer housing 1; a shielded electric wire support member 11 disposed between the ferrule 9 and the first terminal 2, for supporting the shielded electric wire 6 by the first outer housing 1; a waterproof seal 12 for ensuring a waterproof property at a connection part when the first connector 100 is connected to the second connector 200; a wire seal 13 provided on the other end portion on the opposite side to the first terminal 2 which is disposed on one end portion in the first outer housing 1, for ensuring a waterproof property (sealing performance) between the shielded electric wire 6 and the first outer housing 1, a tail plate 14 for preventing detachment of the wire seal 13; a lever 15 for mechanically assisting a connecting operation, when the first outer housing 1 is fitted into the second outer housing 17 of the second connector 200 and detachably connected with each other; and a CPA (Connector Position Assurance) 16 for fixing the lever 15 and showing a connection state between the first connector 100 and the second connector 200.

A main essential part of the second connector 200, being a male side connector, is constituted of a second outer housing 17, being a so-called male connector case; a second inner housing 19 that holds a second terminal 18, being a male terminal, while electrically insulating the second terminal 18 from the second outer housing 17; a looseness restriction member 20 for preventing a looseness between the second inner housing 19 and the first inner housing 3, when the second connector 200 is connected to the first connector 100. A second housing is constituted of the second outer housing 17 and the second inner housing 19.

The first terminal 2 includes a terminal connection part 2*a* into which a base end portion of the second terminal 18 is inserted and which is electrically connected to the second terminal 18; and a cylindrical conductor wire connection part 2*b* into which an exposed conductor wire 21 of the shielded electric wire 6 is inserted and which is electrically connected to the conductor wire 21. The second terminal 18 is fixed to the terminal connection part 2*a* in contact with the inner surface of the terminal connection part 2*a*, by an elastic force of a leaf spring of the terminal connection part 2*a*.

The first outer housing 1 and the second outer housing 17 are made of, for example, a metal material such as aluminum, and the first inner housing 3, the second inner housing 19, the inner plate 4, the tail plate 14, the lever 15, and the CPA 16 are made of, for example, a synthetic resin such as a PBT (polybutylene terephthalate), and the first terminal 2, the second terminal 18, the shielded electric wire support member 11, the ferrule 9, and the ground contact 5 are made of, for example, a metal such as a copper alloy, and the looseness restriction member 20, the waterproof seal 12, and the wire seal 13 are made of, for example an elastic material such as a silicone rubber having high electric insulating property.

As shown in FIG. 2, when the first connector 100 and the second connector 200 are set in a connection state, a face contact is made between opposing end faces of the first inner housing 3 and the second inner housing 19, via the looseness restriction member 20, thus making a structure of restricting the looseness between the first inner housing 3 and the second inner housing 19. In addition, by the second connector 200, the second outer housing 17 is firmly fixed to equipment such as an inverter or a fitting seat, etc, provided on a vehicle side by a screw or bolt, etc, (not shown), thus making a structure not allowing the vibration relative to a vehicle body or equipment to occur, caused by the vibration of the vehicle body or the vibration of the equipment such as an engine.

The exposed braided conductor 8 of the shielded electric wire 6 is folded on the end portion of the sheath 7, and one end portion of the cylindrical ferrule 9 is crimped and fixed to a part where the braided conductor 8 is folded. The other end portion of the ferrule 9 is brought into contact with the inner wall 50*a* of the first outer housing 1 made of a metal material. Then, the first outer housing 1 and the second outer housing 17 are electrically connected to each other via the ground contact 5. Accordingly, a conductive path constituted of the shielded electric wire 6 for making an electrical connection between equipment such as the inverter or the motor, the first terminal 2, and the second terminal 18 is surrounded by the first outer housing 1 and the second outer housing 17, and electrostatically shielded. Therefore, radiation of a noise (electromagnetic waves) from this conductive path to the outside is prevented.

The shielded electric wire support member 11 made of a metal material is disposed between the first terminal 2 and the ferrule 9, in the first outer housing 1, and has a grasping part 11*a* crimped to the outer periphery of the insulator coating 10 of the shielded electric wire 6, for grasping the shielded electric wire 6, and an extension part 11*b* extending to the inner wall 50*a* of the first outer housing 1 from the grasping part 11*a*, in contact with the inner wall 50*a* of the first outer housing 1. The extension part 11*b* of the shielded electric wire support member 11 is provided in a state of a pressure contact with the inner wall 50*a* of the first outer housing 1, and the shielded electric wire 6 is firmly fixed to the first outer housing 1 by the shielded electric wire support member 11. The grasping part 11*a* is a ring-shaped member having some thickness, and firmly fixed to the insulating coating 10 of the shielded electric wire 6. Also, the extension part 11*b* is formed having spring properties in a radial direction of the shielded electric wire 6. Specifically, the extension part 11*b* is formed into a plurality of leaf spring-shaped metal chips as shown in the figures, or is formed into a cylindrical shape, having spring properties and elastic force in the radial direction of the shielded electric wire 6.

In this embodiment, the shielded electric wire 6 is supported by the outer housing 1, using the ferrule 9 and the wire seal 13. In this state, the shielded electric wire support member 11 is further provided, to thereby surely suppress and inhibit the vibration of the shielded electric wire 6 relatively to the first outer housing 1, even if violent vibration of the shielded electric wire 6 occurs due to the vibration of a vehicle body or an engine, for example. Therefore, it is possible to suppress or solve the abrasion of the first terminal 2 and the second terminal 18 and the contact resistance that occurs in association with the abrasion, caused by transmission of the vibration of the shielded electric wire 6 to the first terminal 2 connected to the shielded electric wire 6. As a result, according to the connector of this embodiment, reliability and a long time durability of the electrical connection can be ensured.

The spring properties of the extension part 11*b* of the shielded electric wire support member 11 is set, for example, so that the resonance of a specific frequency range, which occurs in the shielded electric wire 6, can be canceled by the vibration of a vibration system comprising the shielded electric wire support member 11 and the first outer housing 1, etc, connected to the shielded electric wire 6.

The shielded electric wire support member 11 is provided at a position closer to the first terminal 2 in the shielded electric wire 6. Therefore, it is possible to effectively intercept a large vibration that occurs in the shielded electric wire 6, from being propagated to the first terminal 2, by the resonance of the shielded electric wire 6 caused by the vibration transmitted from outside through the shielded electric wire 6, etc.

Incidentally, the first terminal 2, being a part of a power supply line and a signal line, must be positioned with a prescribed distance from the ferrule 9, being a ground, in consideration of a noise, etc. Therefore, the ferrule 9 can not be actually disposed closer to the first terminal 2. Accordingly, with the ferrule 9 only, it is difficult to effectively prevent the vibration from being transmitted to the first terminal 2 from the shielded wire 6. However, when the ferrule 9 and the shielded electric wire support member 11 are provided, the shielded electric wire 6 is supported at two points. Thus, the vibration can be effectively inhibited.

In addition, in the shielded electric wire 6, a state between the sheath 7 and the braided conductor 8, and a state between the braided conductor 8 and the insulator coating 10, are not set in a completely rigid fixed state, but set in a flexible state that they are mutually slightly moved. A part of the sheath 7 is located at a position apart from the first terminal 2. Therefore, for example, even if a part of the sheath 7 of the shielded electric wire 6 is grasped by the ferrule 9 and the shielded electric wire support member 11, etc, it is difficult to effectively inhibit the vibration transmitted to the shielded electric wire 6 from outside.

Therefore, in this embodiment, by grasping a part of the insulator coating 10 in a more rigid state than a part of the sheath 7 at a position closer to the first terminal 2 than a position of the shielded electric wire grasped by the ferrule 9, it becomes possible to effectively inhibit the vibration of the shielded wire from being transmitted to the first terminal 2.

For example, in the embodiment shown in FIG. 2, by disposing the shielded electric wire support member 11 so as to grasp the shielded electric wire 6 at almost an intermediate position between the position of the shielded electric wire 6 grasped by the ferrule 9, and the first terminal 2, the vibration propagated to the first terminal 2 from the shielded electric wire 6 is effectively inhibited. Also, by disposing the shielded electric wire support member 11 so as to grasp the shielded electric wire 6, at a position closer to the first terminal 2 as much as possible, and most preferably at a position almost contacting with the first terminal 2, the vibration of the shielded electric wire 6, etc, can be most effectively inhibited.

In addition, the shielded electric wire support member 11 is fitted so as to grasp the outer periphery of the insulator coating 10 between the first terminal 2 and the ferrule 9, with an outer diameter of the extension part 11*b* contacted with the inner wall 50*a* of the first outer housing 1 of the shielded electric wire support member 11 set to be larger than an outer diameter of the ferrule 9 of a part contacting with the inner wall 50*a* of the first outer housing 1. An inner diameter of the fist outer housing 1 set to be larger at a part where the shielded electric wire support member 11 is fitted, than at a part where the ferrule 9 is fitted.

Thus, in an assembly step of the first connector 100, when the shielded electric wire 6 including the shielded electric wire support member 11 and the ferrule 9 is inserted into the first outer housing 1, a friction caused by a contact between the inner wall 50*a* of the first outer housing 1, the shielded electric wire support member 11, and the ferrule 9 can be made minimum.

Further, by differentiating the outer diameter of the shielded electric wire support member 11 and the outer diameter of the ferrule 9, which are contacted with the inner wall 50*a* of the first outer housing 1, it is possible to shorten a sliding distance of a contact part between the inner wall 50*a* of the first outer housing 1, the shielded electric wire support member 11, and the ferrule 9. Then, the friction caused by this contact can be reduced.

After conducting a test of giving forced vibration to the shielded electric wire, and after study on its result by inventors of the present invention, it becomes possible to clarify a cause for generating the abrasion and the contact resistance in the conventional connector not provided with the shielded electric wire support member 11.

Figure 3:
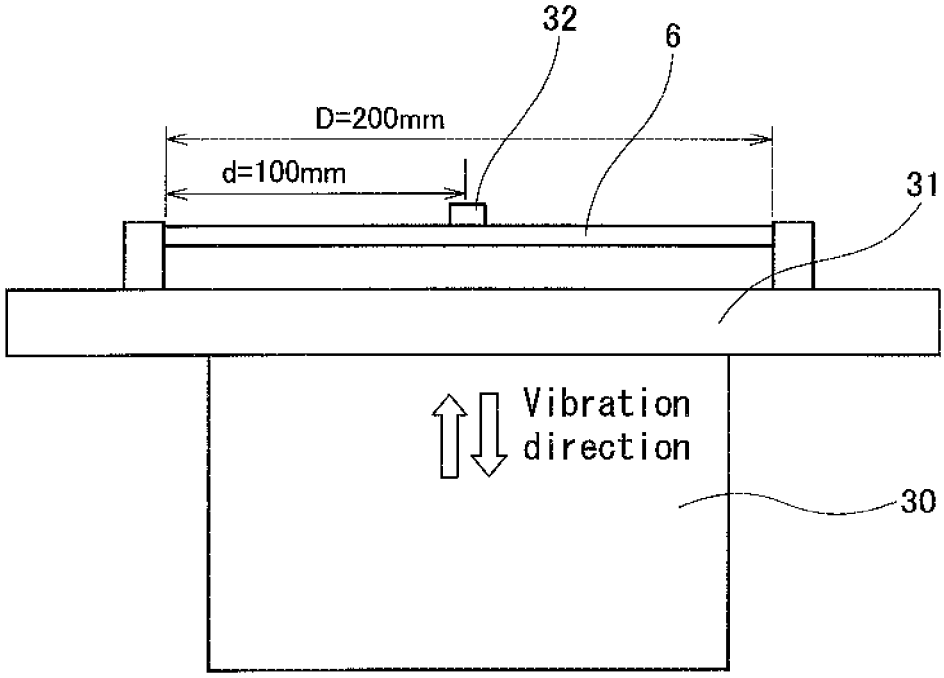
FIG. 3 is a view showing an outline of a vibration test device for examining a vibration transmissibility of the shielded electric wire.
Figure 4:
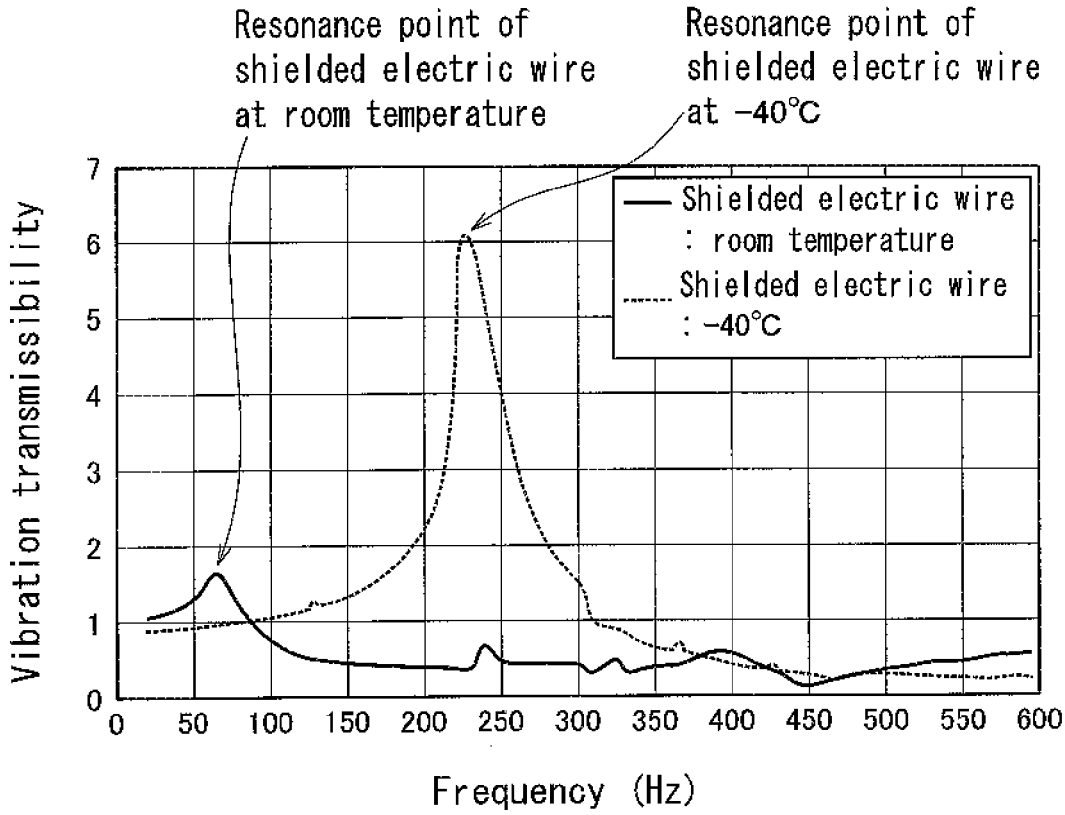
FIG. 4 is a graph showing the vibration transmissibility of the shielded electric wire, obtained by the vibration test using the test device shown in FIG. 3.

FIG. 3 is a view showing an outline of a test device for examining a vibration transmissibility by giving forced vibration to the shielded electric wire 6, and FIG. 4 is a graph showing the vibration transmissibility of the shielded electric wire 6 obtained by the vibration test using the test device shown in FIG. 3.

When the conventional connector not provided with the shielded electric wire support member 11 is used under a low temperature environment such as −40° C., Young's modulus of the conductor wire 21 of the shielded electric wire 6, the insulator coating 10, the braided conductor 8, and the sheath 7, etc, are increased by temperature characteristics. Therefore, rigidity of the shielded electric wire 6 tends to be higher, at the low temperature. At this time, for example, when the vibration that occurs during traveling of an automobile is transmitted to the shielded electric wire 6, resonance occurs in the shielded electric wire 6, which is then transmitted to the first terminal 2 of the connector connected to the shielded electric wire 6, resulting in a large vibration given to the first terminal 2 and the second terminal 18.

For the aforementioned reason, the abrasion and the increase of the contact resistance occur in the first terminal 2 and the second terminal 18, thereby consequently involving a problem that the reliability of the electrical connection and the long time durability are reduced. This fact is found by the inventors of the present invention, from a result of the vibration test. Then, based on a knowledge thus obtained, the connector provided with the shielded electric wire support member 11 according to the embodiments of the present invention is achieved.

In the vibration test using the test device shown in FIG. 3, both end portions of the shielded electric wire 6 having 200 mm length were fixedly grasped on a vibration table 31, then a vibration generator 30 was operated to forcibly give vibration to the shielded electric wire 6 supported by the vibration table 31. Then, the vibration transmissibility at this time was measured by a vibration acceleration measurement sensor 32 attached to the center portion of the shielded electric wire 6.

A sectional area of the conductor wire 21 of the shielded electric wire 6 was set at 20 $mm^2$, and the insulator coating 10 and the sheath 7 made of fluro-rubber were used.

A measurement result is shown in FIG. 4. As clarified from FIG. 4, it was confirmed that vibration transmissibility of the shielded electric wire 6 at a room temperature and at −40° C. clearly show different values. Namely, although a resonance point of the shielded electric wire 6 is set in the vicinity of 65 Hz at a room temperature, a resonant point, at which the vibration transmissibility becomes remarkably large, is generated in the vicinity of 226 Hz at −40° C. The vibration transmissibility of the resonance point at −40° C. becomes remarkably large such as about 3.67 times the vibration transmissibility of the resonance point at a room temperature.

This is because material characteristics of the shielded electric wire 6 are changed by change of the temperature, and along with this change, a resonance frequency and the vibration transmissibility of the shielded electric wire 6 are changed, to thereby generate the resonance of a large amplitude by the given forced vibration. When such a strong resonance is generated in the shielded electric wire 6, the vibration is also transmitted to the first outer housing 1 and the first terminal 2, etc, from the shielded electric wire 6 via the ferrule 9 and the wire seal 13, etc. Therefore, the large vibration is given to an entire body of the connector. In such a case, the first terminal 2, being an electrical contact part in the first connector 100 and the second terminal 18 contacting with the first terminal 2 are also remarkably vibrated. Generally, the terminal of the connector is set, so that one of the terminals is fixed to the other terminal in a contact state by an elastic force of a leaf spring, etc. However, when a strong vibration caused by the resonance as described above is given, a larger force than the elastic force (contact force) of a spring of the terminal is added to this terminal, and the terminal can not be held in a fixed state. Therefore, the terminals are moved, thereby causing the abrasion and the increase of the contact resistance to occur in the contact part between both terminals, or causing inconvenience such as a heat generation of the terminal to occur.

However, according to the connector of this embodiment of the present invention as described above, the shielded electric wire 6 is firmly supported by the shielded electric wire support member 11 in the first outer housing 1. Therefore, propagation of the large vibration that occurs in the shielded electric wire 6 can be significantly effectively inhibited from being propagated to the first terminal 2, thus consequently making it possible to ensure the reliability and long time durability of the electrical connection of the connector.

As an example of a circumstance in which vibration is given to the connector, the aforementioned vibration test was conducted based on an estimation of a case in which the rigidity of the shielded electric wire 6 is increased at a low temperature such as −40° C., then the resonance point becomes higher than the resonance point at a room temperature, and accordingly the vibration transmissibility becomes remarkably higher. However, other than the aforementioned case, in a case of giving vibration caused by traveling of an automobile at a room temperature, and in a case of the connector using the shielded electric wire 6 having different resonance characteristics from the aforementioned resonance characteristics (resonance frequency and the value of the vibration transmissibility) also, similarly as described above, the abrasion of the terminal and the increase of the contact resistance are likely to occur, caused by a resonance phenomenon of the shielded electric wire 6. Therefore, in these cases also, it is a matter of course that by using the shielded electric wire support member 11, the abrasion of the terminal and the increase of the contact resistance can be inhibited or solved.

Here, the aforementioned embodiment describes a structure of the shielded electric wire 6 in which a circumference of one conductor wire 21 is surrounded by the braided wire 8. However, other than this structure, it is also possible to use the structure of the shielded electric wire in which two, three or more of a plurality of coated electric wires are bundled and the circumference thereof is collectively shielded by the braided conductor. In this case, for example, the connector can also has a structure in which the terminal portion of the collectively shielded braided wire is connected to the first outer housing or the shield shell, and the ferrule is omitted. The aforementioned shielded electric wire support member 11 can be applied to the connector of this structure, and in this case also, similarly as described above, the vibration propagated to the first terminal 2, etc, from the shielded electric wire 6 caused by external vibration, etc, can be effectively intercepted or inhibited by the shielded electric wire support member 11.

Figure 5:
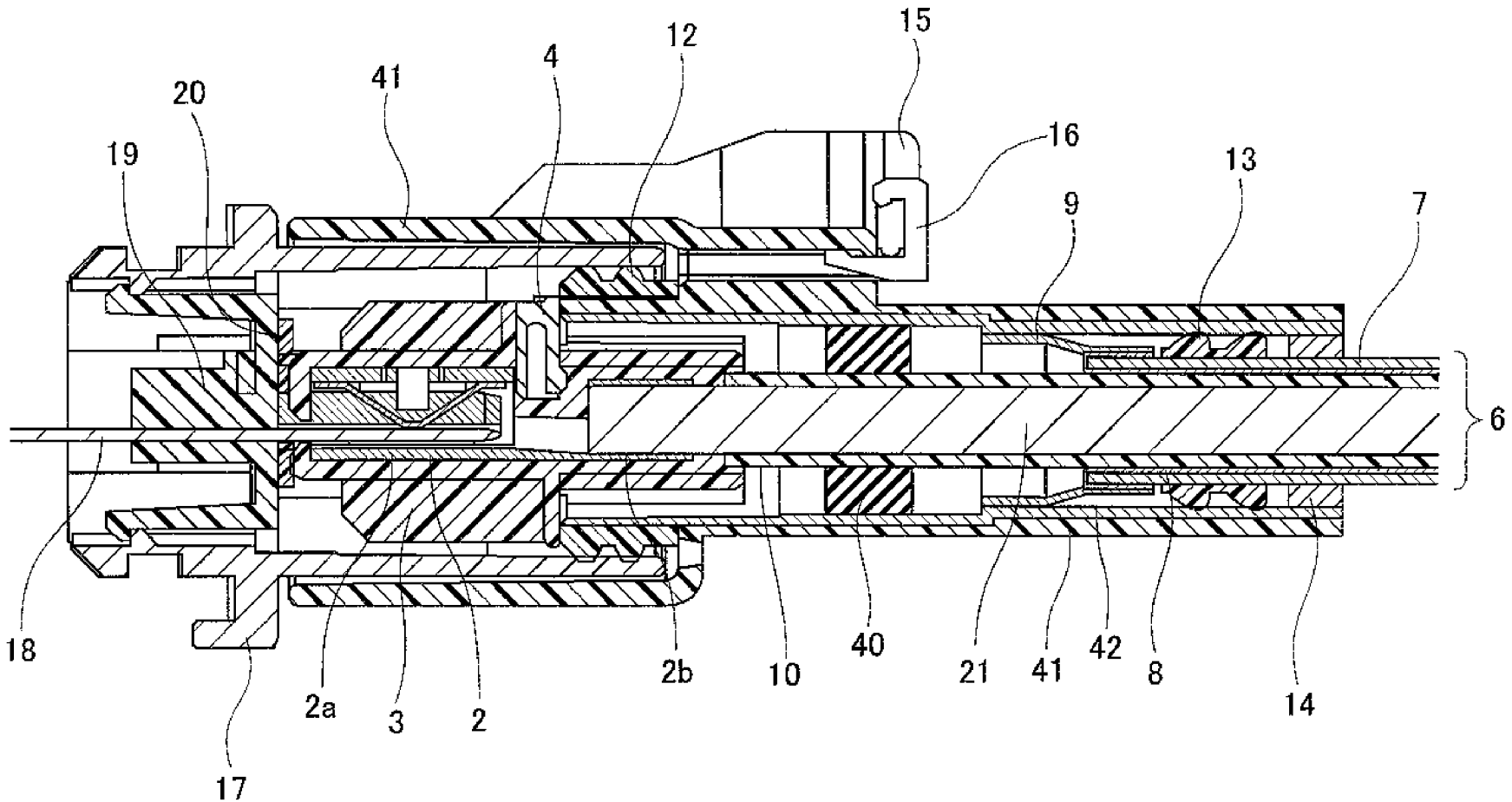
FIG. 5 is a longitudinal sectional view showing a state of connecting the connector of other embodiment of the present invention, to the shielded electric wire.

FIG. 5 shows a longitudinal sectional view of a connection state in which the shielded electric wire is connected by using the connector according to other embodiment of the present invention. In this embodiment, a shielded electric wire support member 40 made of a rubber material such as a silicone rubber is provided, instead of the shielded electric wire support member 11 made of a metal material of the aforementioned embodiment.

As shown in the figure, the shielded electric wire support member 40 of this embodiment has a cylindrical shape or a ring shape, and is provided at a part of the insulator coating 10 between the conductor wire connection part 2*b* of the first terminal 2 and the ferrule 9. The shielded electric wire support member 40 is attached to the outer periphery of the insulator coating 10 to grasp the insulator coating 10 and support the shielded electric wire 6 by a first outer housing 41, with an outer peripheral surface of the shielded electric wire support member 40 set in a contact state with the first outer housing 41. The shielded electric wire support member 40 made of a rubber material may be attached to the shielded electric wire 6, for example in such a manner as being attached to the insulator coating 10 with an opening of the shielded electric wire support member 40 expanded, or in such manner as being attached to the insulator coating 10 by using an adhesive agent between the outer peripheral surface of the insulator coating 10 and an inner peripheral surface of the shielded electric wire support member 40. Preferably the shielded electric wire support member 40 made of a rubber material is provided in a compressed state between the shielded electric wire 6 and the first outer housing 41, in such a manner that the shielded electric wire support member 40 is brought into pressure contact with the shielded electric wire 6 and the first outer housing 41.

In providing the shielded electric wire support member 40 in the shielded electric wire 6, material quality and hardness, etc, of the rubber material having viscoelasticity are selected, and a dimension of the shielded electric wire support member 40 in a longitudinal direction (wire direction) or a setting position on the shielded electric wire 6, and so forth, are adjusted, so that the vibration of the shielded electric wire 6, being a problem, can be effectively prevented.

Note that a plurality of shielded electric wire support members made of a rubber material may be provided at a part of the insulator coating 10 between the conductor wire contact part 2*b* of the first terminal 2 and the ferrule 9.

A so-called vibration isolating rubber such as nitrile rubber having a damping effect can also be used as the rubber material used in the shielded electric wire support member 40, other than the silicone rubber. In addition, by further increasing the hardness of such rubber materials, the shielded electric wire 6 can be further firmly supported, and the propagation of the vibration of the shielded electric wire 6 to the first terminal 2 can be further surely intercepted or inhibited. In addition, by using the shielded electric wire support member 40 made of a rubber material, it is possible to obtain an advantage in terms of the assembly step, such that an attachment to the shielded electric wire 6, etc, can be easy.

Also, in the embodiment shown in FIG. 1 and FIG. 2, the first outer housing 1 and the second outer housing 17 are made of a metal material. However, in this embodiment shown in FIG. 5, the first outer housing 41 is made of a resin material, and a metal shield shell 42 is provided on an inner peripheral surface thereof as a so-called lining. The ferrule 9 is set in contact with the shield shell 42. The second outer housing 17 may also be made of a resin material, and the shield shell made of metal may be provided on an inner wall surface of the second outer housing.

Alternately, the shielded electric wire support member can also be made of, for example, a resin material, other than the metal material and the rubber material. However, generally, deformation sometimes occurs in the resin material, when cooled after a stress is added in an environment of a high temperature. Therefore, a resin material without such a risk must be selected.

In addition, some of the shielded electric wire support member made of the aforementioned metal material, rubber material, resin material or further other material, possibly has the same or similar resonance characteristics as the resonance characteristics of the shielded electric wire. In a case of the shielded electric wire support member using such a material, there is a possibility that the shielded electric wire support member can not contribute to a isolating/damping action, due to the resonance with vibration from outside, together with the shielded electric wire. Therefore, it is desirable to use the shielded electric wire support member having different resonance characteristics from the resonance characteristics of the shielded electric wire 6, corresponding to the structure and material quality of the shielded electric wire 6.

Although the aforementioned embodiment describes a case in which only one shielded electric wire support member 11 is fitted to the shielded electric wire, a plurality of shielded electric wire support members may also be fitted. Thus, the shielded electric wire 6 can be supported at a plurality of positions, and the vibration propagated from this shielded electric wire 6 to the first terminal 2 can be surely intercepted or inhibited.

Also, when the ferrule 9 and the wire seal 13 are set apart from each other, the shielded electric wire support member may be disposed in the sheath 7 between the ferrule 9 and the wire seal 13. Thus, the vibration propagated to the first terminal 2 from the shielded electric wire 6 can be further surely intercepted or inhibited, because the sheath 7 of the shielded electric wire 6 is supported by not only the ferrule 9 and the wire seal 13 but also by the shielded electric wire support member.

As described above, according to the connector of the embodiments of the present invention, the shielded electric wire 6 is supported by the shielded electric wire support members 11 and 40. Therefore, the vibration from the shielded electric wire 6 can be prevented from being transmitted to the first terminal 2 and the first outer housing 1, etc, and consequently it becomes possible to ensure the reliability and durability of the electrical connection between the first terminal 2, being an electrical contact part, and the second terminal 18 connected thereto.

In addition, there is also an advantage in terms of a manufacture and an assembly, such that the reliability and durability of the electrical connection can be ensured as described above, only by minimum change of a shape of the first outer housing, and only by adding minimum components, namely by basically adding the shielded electric wire support member.

What is claimed is:

1. A connector, comprising:

a first terminal electrically connected to a conductor wire of a shielded electric wire, the shielded electric wire including the conductor wire, an insulator coating for coating the conductor wire, a braided conductor for coating the insulator coating, and a sheath for protecting an outer periphery of the braided conductor;

a second terminal electrically connected to the first terminal;

a housing provided so as to surround a connection part of the first terminal and the second terminal and a peripheral part thereof, composed of a first housing that holds the first terminal and a second housing that holds the second terminal; and a shielded electric wire support member provided in the first housing, for crimping to the outer periphery of the insulator coating of the shielded electric wire inserted into the first housing, and supporting the shielded electric wire by the first housing in press-contact with an inner wall of the first housing.

2. The connector according to claim 1, wherein the shielded electric wire support member is crimped to the insulator coating of the shielded electric wire inserted into the first housing, at a position in a vicinity of the first terminal.

3. The connector according to claim 1, further comprising a ferrule that grasps the braided conductor of the shielded electric wire inserted into the first housing, and electrically connects the braided conductor and the inner wall of the first housing, in contact with the inner wall of the first housing.

4. The connector according to claim 3, wherein the shielded electric wire support member is crimped to the insulator coating of the shielded electric wire, at a position closer to the first terminal than a position of the braided conductor of the shielded electric wire grasped by the ferrule.

5. The connector according to claim 3, wherein an outer diameter of a part contacting with the inner wall of the first housing of the shielded electric wire support member is different from an outer diameter of a part press-contacting with the inner wall of the first housing of the ferrule.

6. The connector according to claim 3, further comprising a metal shield shell contacting with the ferrule and being formed on an inner wall surface of the first housing.

7. The connector according to claim 1, wherein the shielded electric wire support member is made of a rubber material.

8. The connector according to claim 1, wherein the first terminal is held by one end portion of the first housing, with a second end portion on an opposite side to the one end portion of the first housing having a wire seal for sealing a space between the first housing and the shielded electric wire inserted into the first housing.

9. The connector according to claim 1, wherein the first housing is fitted into the second housing and detachably connected to each other.

10. The connector according to claim 1, wherein the first housing has a first inner housing made of an insulator that holds the first terminal, and a first outer housing made of metal provided on an outer periphery of the first inner housing.

11. The connector according to claim 1, wherein the second housing has a second inner housing made of an insulator that holds the second terminal, and a second outer housing made of metal provided on an outer periphery of the second inner housing.

12. A connector, comprising:

a first terminal electrically connected to a conductor wire of a shielded electric wire, the shielded electric wire including the conductor wire, an insulator coating for coating the conductor wire, an external conductor for coating the insulator coating, and a sheath for protecting an outer periphery of the external conductor;

a second terminal electrically connected to the first terminal;

a housing provided so as to surround a connection part of the first terminal and the second terminal and a peripheral part thereof, composed of a first housing that holds the first terminal and a second housing that holds the second terminal; and a shielded electric wire support member provided in the first housing, for crimping to the outer periphery of the insulator coating of the shielded electric wire inserted into the first housing, and supporting the shielded electric wire by the first housing in press-contact with an inner wall of the first housing.

* * * * *